US007983586B2

(12) United States Patent
Fowler et al.

(10) Patent No.: US 7,983,586 B2
(45) Date of Patent: Jul. 19, 2011

(54) AUTOMATED CLEANER FOR CHARGING

(75) Inventors: Jeffrey M Fowler, Rochester, NY (US); Michael A Doody, Manchester, NY (US)

(73) Assignee: Xerox Corporation, Norwalk, CT (US)

( * ) Notice: Subject to any disclaimer, the term of this patent is extended or adjusted under 35 U.S.C. 154(b) by 382 days.

(21) Appl. No.: 12/201,035

(22) Filed: Aug. 29, 2008

(65) Prior Publication Data

US 2010/0054794 A1 Mar. 4, 2010

(51) Int. Cl.
*G03G 15/00* (2006.01)

(52) U.S. Cl. ..... 399/100

(58) Field of Classification Search ..... 399/100, 399/99, 101, 98

See application file for complete search history.

(56) References Cited

U.S. PATENT DOCUMENTS

| | | | | |
|---|---|---|---|---|
| 5,485,255 | A * | 1/1996 | Reuschle et al. | 399/168 |
| 2003/0180065 | A1 * | 9/2003 | Walgrove et al. | 399/100 |
| 2003/0231896 | A1 * | 12/2003 | Kikuchi | 399/100 |

FOREIGN PATENT DOCUMENTS

JP 2005099204 A * 4/2005

* cited by examiner

*Primary Examiner* — Quana M Grainger
(74) *Attorney, Agent, or Firm* — Lloyd F. Bean, II

(57) ABSTRACT

There is provided a corona generating device for a printing machine, including a conductor; a frame for supporting the conductor; a cleaning assembly, within the frame, for cleaning the conductor, the cleaning assembly includes a cleaning carriage, a drive system for translating the cleaning carriage along the length of the conductor in a path of movement, the cleaning assembly further includes a cleaning pad, means for engaging a portion of the clean pad into contact with conductor, and means for translating the cleaning pad from an used portion to an unused portion of the cleaning pad.

11 Claims, 5 Drawing Sheets

AUTOMATED CLEANER FOR CHARGING

BACKGROUND AND SUMMARY

This invention relates generally to a corona generating device, and more particularly concerns a method and apparatus for cleaning the electrode element on a corona generating device.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith.

Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. In printing machines such as those described above, corona devices perform a variety of other functions in the printing process.

For example, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions. One form of a corona charging device comprises a corona electrode in the form of an elongated wire connected to a high voltage AC/DC power supply. Alternatively, a charging device may comprise an array of pins integrally formed from a sheet metal member.

The scorotron is similar to the pin corotron, but is additionally provided with a screen or control grid disposed between the coronode and the photoconductive member. The screen is held at a lower potential approximating the charge level to be placed on the photoconductive member. The scorotron provides for more uniform charging and prevents overcharging.

A problem with electrophotographic printing process is the accumulation of silica and other contamination on the corona wire. These accumulations are adhered onto the corona wire due to the high voltage placed on the corona wire during operation. These accumulations can deteriorate the image quality and can interrupt the continuous use of these printers by causing print defects, such as dark streaks on the printed pages. For some cases, these defects could be cured by simply wiping the contamination from the small thin corona wire.

Manual or automatic cleaners are routinely employed to remove silica and other materials from corotron wires to prolong the generation of strong, uniform corona. Automatic cleaners are generally more effective than manual cleaners because the cleaning schedule can be more tightly controlled. Because the same part of the cleaning pad always cleans the same part of the wire or grid, in some cases the cleaner removes contamination in long strips along the wire, while leaving adjacent strips uncleaned.

The present disclosure obviates the problems noted above by replacing the stationary grid pad holder with a rotating holder. In ordinary operation of the cleaning cycle actuates the rotation so that a different part of the cleaning pads engages the wire or grid with each cleaning cycle. These several configurations clean the wire more thoroughly over the course of several cleaning cycles, resulting in improved print quality and extended life.

There is provided a corona generating device for a printing machine, including a conductor; a frame for supporting said conductor; a cleaning assembly, within said frame, for cleaning said conductor, said cleaning assembly includes a cleaning carriage, a drive system for translating said cleaning carriage along the length of said conductor in a path of movement, said cleaning assembly further includes a cleaning pad, means for engaging a portion of said clean pad into contact with conductor, and means for translating said cleaning pad from an used portion to an unused portion of said cleaning pad.

Other features of the present invention will become apparent as the following description proceeds and upon reference to the drawings, in which.

Figure 1:
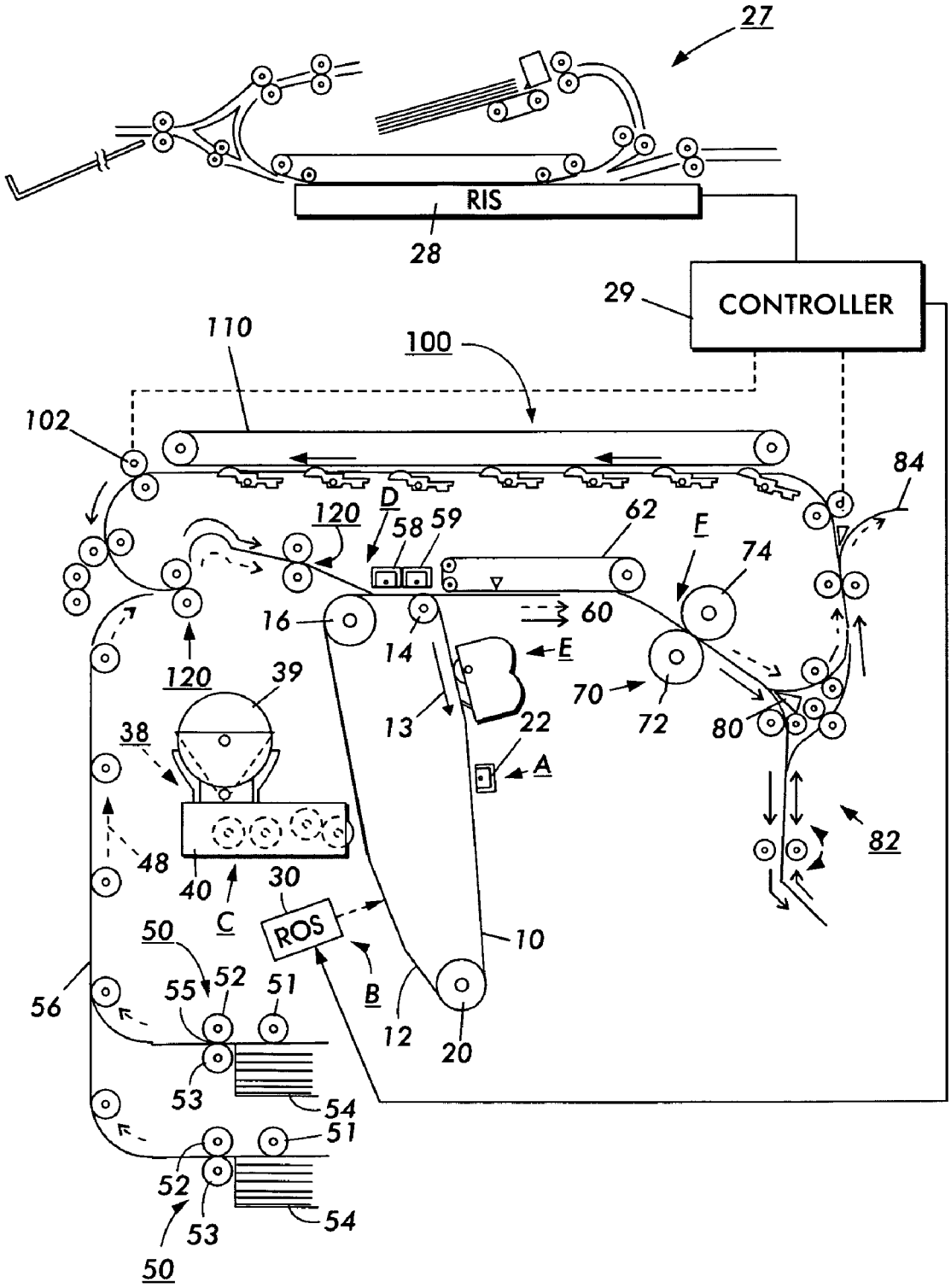
FIG. 1 is a schematic elevational view of a typical electrophotographic printing machine utilizing the corona shield of the present invention.

While the present disclosure will be described in connection with a preferred embodiment thereof, it will be understood that it is not intended to limit the disclosure to that embodiment. On the contrary, it is intended to cover all alternatives, modifications, and equivalents as may be included within the spirit and scope of the disclosure as defined by the appended claims.

For a general understanding of the features of the present disclosure, reference is made to the drawings. In the drawings, like reference numerals have been used throughout to identify identical elements.

FIG. 1 schematically depicts an electrophotographic printing machine incorporating the features of the present disclosure therein. It will become evident from the following discussion that the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below. FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Photoconductive belt 10 moves in the direction of arrow 13 to advance successive portions sequentially through the various processing stations disposed about the path of movement thereof. Photoconductive belt 10 is entrained about stripping roller 14, tensioning roller 20 and drive roller 16. As drive roller 16 rotates, it advances photoconductive belt 10 in the direction of arrow 13. Initially, a portion of the photoconductive surface passes through charging station A.

At charging station A, a corona generating device indicated generally by the reference numeral 22 charges the photoconductive belt 10 to a relatively high, substantially uniform potential. At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks.

The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis. After the electrostatic latent image has been recorded on photoconductive surface 12, belt 10 advances the latent image to a development station, C, where toner, in the form of liquid or dry particles, is electrostatically attracted to the latent image using commonly known techniques.

The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on photoconductive belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56.

Vertical transport 56 directs the advancing sheet 48 of support material into the registration transport 120, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller 72 to provide the necessary pressure to fix the toner powder image to the copy sheet. The fuser roller is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roller 72. The sheet then passes through fuser assembly 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84.

However, if the sheet is being duplexed and is then only printed with a side one image, the gate 80 will be positioned to deflect that sheet into the inverter 82 and into the duplex path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84. After the print sheet is separated from photoconductive surface 12 of photoconductive belt 10, the residual toner/developer and paper fiber particles adhering to photoconductive surface 12 are removed therefrom at cleaning station E.

Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller 29 provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
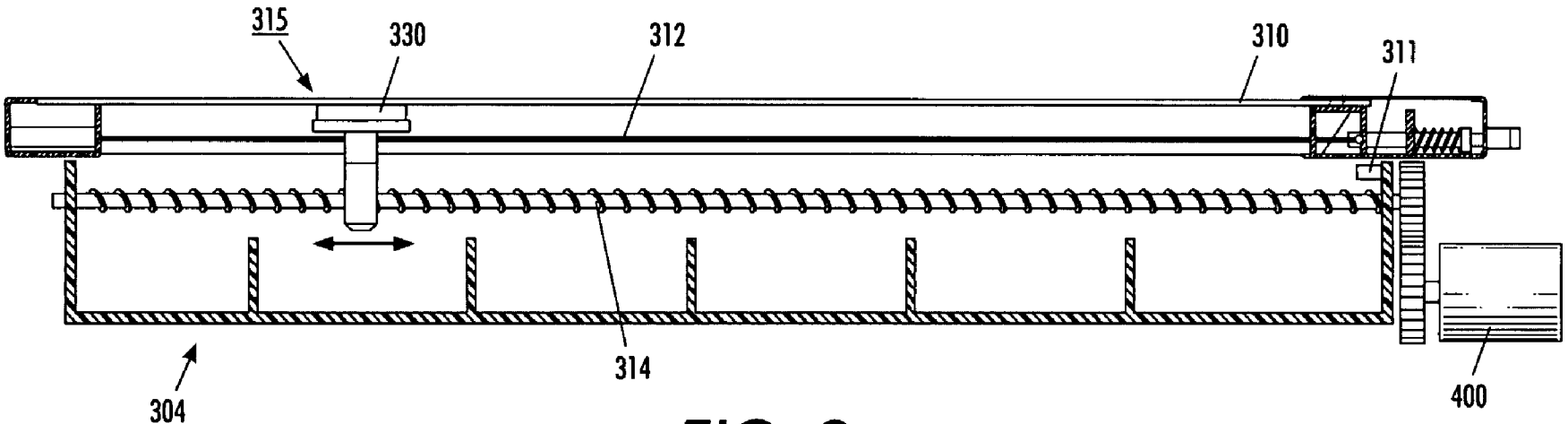
FIGS. 2-8 are schematic views illustrating the cleaning device present disclosure.

Turning next to FIG. 2, focusing on the cleaning device of the present disclosure, as illustrated the grid 310 is installed in the frame 304. Frame 304 has a groove which supports grid 310 therein. Wire 312 are positioned below grid 310. The charging devices include end blocks, which support wire 312. The cleaning device of the present disclosure employs annular cleaning pads for the grid and the grid side of the wire. Both cleaning pads are mounted on a circular base with a mechanism to rotate the base a fraction of a turn each time the cleaner returns to the home position. For example design rotates the pads by 45° with each cleaning cycle. In this case, the wire and grid are each effectively cleaned by eight different cleaning pads. If each of the eight orientations cleans a few strips of the wire or grid, the various strips will overlap so that over time, the entire wire or grid will be cleaned thoroughly.

Cleaning device 315 is driven along the inner portion of charging device by a lead screw 314 being rotated by motor 400. Cleaning device 315 has a scrub pad 330 on the top surface thereof for cleaning any particles (ie toner or debris) adhering to grid 310 as the cleaning device moves along the charging device. Wire cleaning pads remove any particles (ie silica or debris) adhering to wire 312 as the cleaning carriage moves along the charging device.

Figure 3:
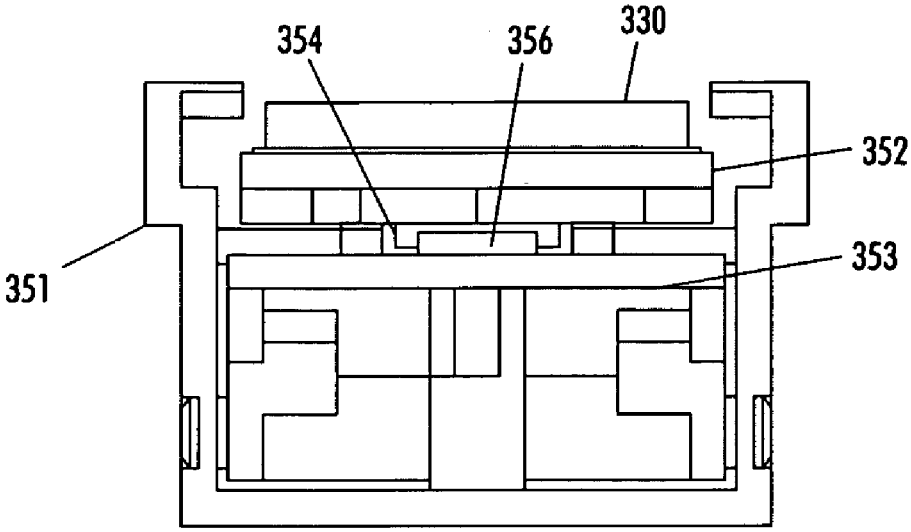
Figure 4:
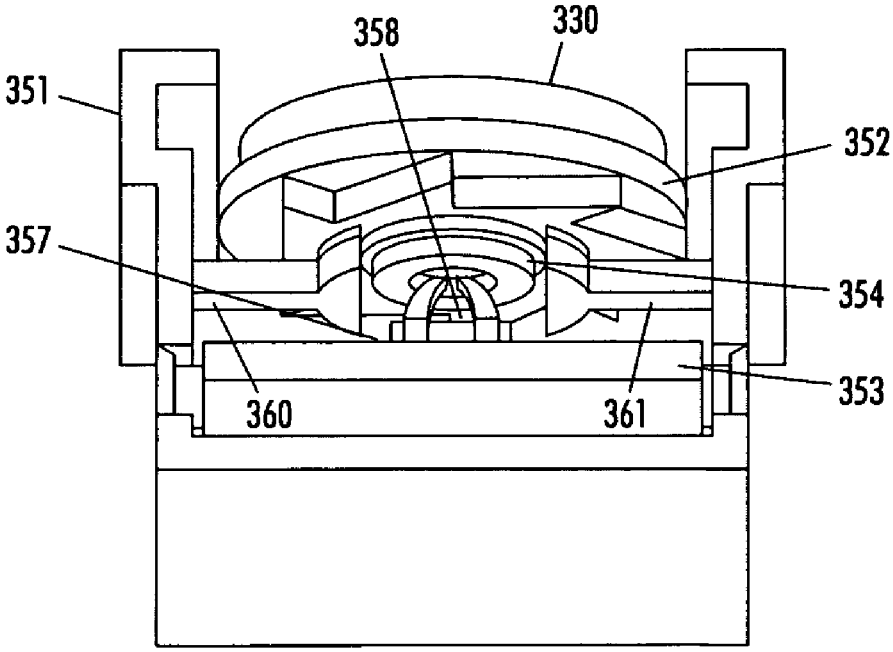
Figure 5:
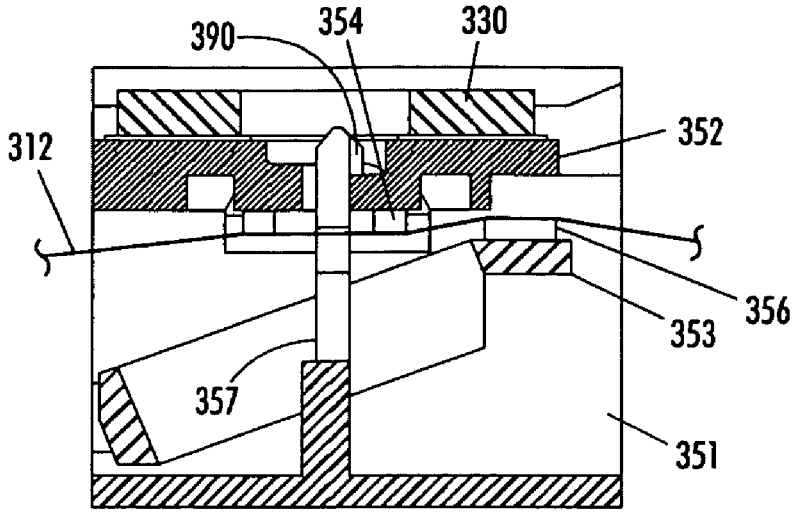

Turning next to FIGS. 3, 4 and 5, as illustrated in FIG. 3 is a view of cleaner assembly facing the home position. Cleaner assembly includes ratchet wheel 352 that has wire cleaning pad 354 on a bottom surface thereof and grid cleaning pad 330 on a top surface thereof. Ratchet wheel 352 is rotatably mounted thereto to support member 357. Support member 357 has aperture 358 defined therein wherein wire 312 passes there through. Wire pad holder 353 holds wire pad 356 and is adapted to move from an unengaged position to an engaged position. In the engaged position wire pad 356 contacts wire 312 and moves wire 312 into contact with wire cleaning pad 354.

Protrusion 311 at the home position (shown in FIG. 2) acts to retract the wire pad holder 353 away from the wire, disengaging the wire from both wire pads in the same operation. A protrusion 311 pushes against the ratchet wheel 352 and advance it one notch. This protrusion will deform toward the left as the next tooth from ratchet wheel 352 comes into position, until it springs back into place, preventing the wheel from turning backward. Ratchet wheel 352 has eight teeth which indexes wire pad into eight cleaning pad areas. The number of teeth on ratchet wheel 352 or number of cleaning pad areas could be different; however it is preferred to use as many teeth as is practical on ratchet wheel 352 or cleaning pad areas.

Figure 7:
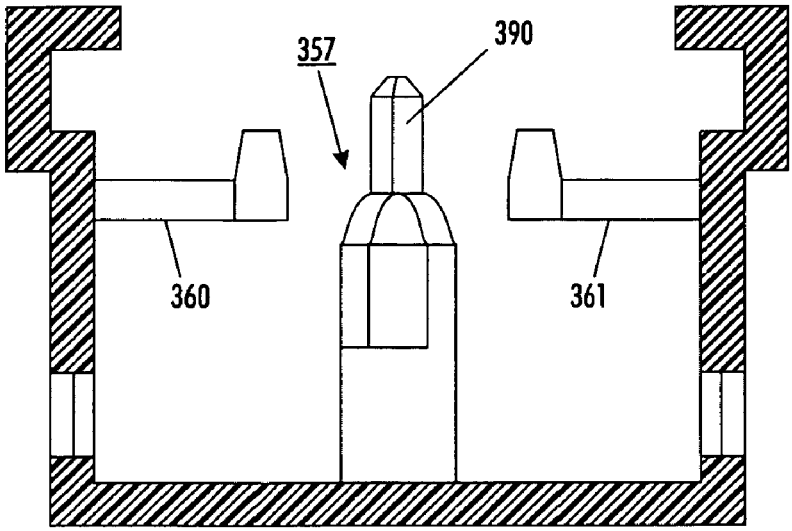
Figure 8:
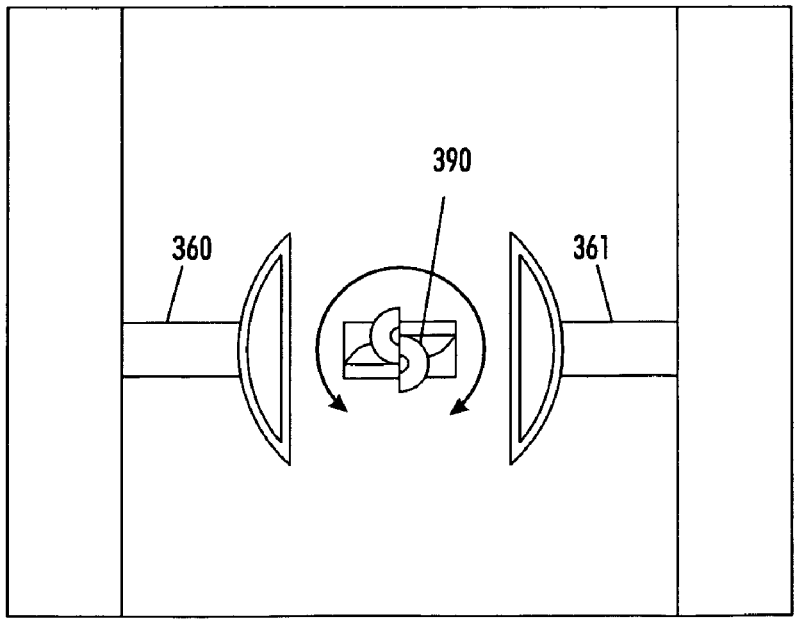

FIG. 4 illustrates a view of cleaner assembly from below, showing detail of the teeth on ratchet wheel 352 and the wire cleaning pad 354. Also in view are the supports 360 and 361 built into the holder base which prevent ratchet wheel 352 from wobbling and bias it against the grid. The dimensions of the support arms are chosen to deflect with an appropriate spring force when the ratchet wheel 352 is pressed away from the grid 315. Snap feature 390 on top portion of support member 357 (as shown in FIGS. 5 and 7) is shaped to allow clearance for the wire when not engaged with wire pad 356, and how the ratchet wheel rests on the support arms 360 and 361.

FIG. 5 illustrates a view of cleaner assembly illustrating the approximate path of the wire through the assembly. Note how the wire clears the snap feature 365 due to the way the annular wire pad 356 presses against it. When the wire pad holder retracts in home position, the wire will rest lower clearing the snap feature even more.

Figure 6:
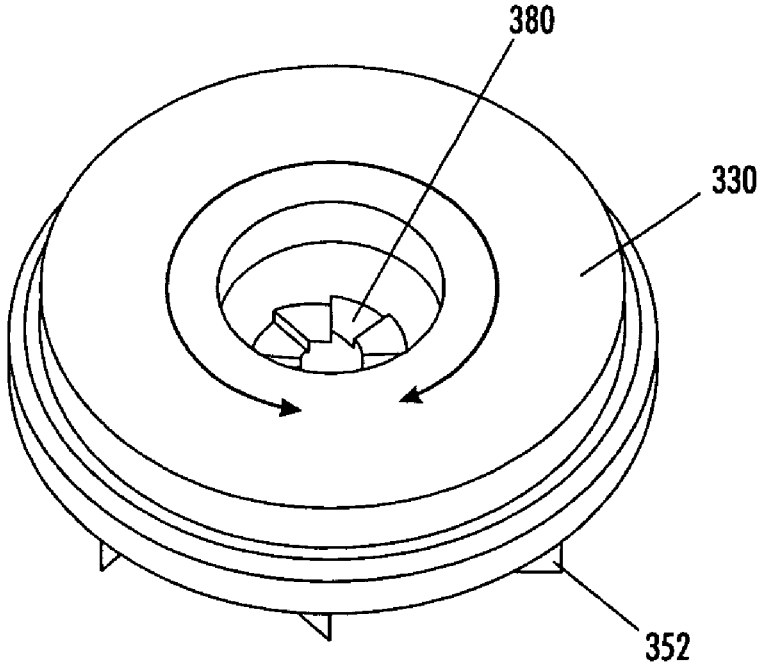

Having in mind the construction and the arrangement of the principal elements thereof, it is believed that a complete understanding may now be had from a description of its operation. During cleaning the cleaner of the present disclosure operates much like a conventional cleaner. As the cleaner approaches the home position, protrusion 311 on the insulator disengage the wire pad holder 353 from the wire, then advance the ratchet wheel 352 one notch. As the ratchet wheel 352 turns, the upper ratchet 380 (as shown in FIG. 6) pushes grid cleaning pad 330 away from the grid, to which the support arms comply. Shortly before the protrusion from the insulator snaps to the next tooth on the ratchet wheel 352, the snap feature 390 snaps to the next tooth on the upper ratchet 380 (as shown in FIG. 6), holding the ratchet wheel in place as it moves away from the protrusion during the next cleaning cycle. Over the course of eight cleaning cycles, eight different parts of cleaning pad 354.engage the wire, so the wire is cleaned thoroughly. One part of the wire pad will clean sections of the wire that other parts of the cleaning pad 354 may have missed. Also, the grid pad or brush presses on the grid from eight different directions and in eight configurations relative to the grid. All of this is accomplished using the same number of parts as a conventional cleaner, so that the cost of the assembly is nearly equal to that of a conventional cleaner. With the extended life enabled by more thorough cleaning, the overall run cost is decreased. A more thorough cleaning also improves charge uniformity, resulting in improved customer satisfaction with print quality. The concept may be readily extended to a two wire corotron. The only notable changes would be that the annular wire pad would be of a diameter to simultaneously engage both wires, and the wire pad holder and holder base would be reconfigured to allow for a center shield. In this case the bases of the two halves of the snap feature would be on opposite sides of the center shield.

It is, therefore, apparent that there has been provided a cleaning device in accordance with the present invention fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A corona generating device for a printing machine, comprising:

a conductor;

a frame for supporting said conductor;

a cleaning assembly, within said frame, for cleaning said conductor, said cleaning assembly includes a cleaning carriage, a drive system for translating said cleaning carriage along the length of said conductor in a path of movement, said cleaning assembly further includes a cleaning pad having a plurality of cleaning portions, means for engaging one of said plurality of cleaning portions of said clean pad into contact with conductor, and means for translating said one of said plurality of cleaning portions of cleaning pad to a second one of said plurality of cleaning portions of said cleaning pad.

2. A corona generating device according to claim 1 wherein said conductor is a wire.

3. A corona generating device according to claim 1 wherein said drive system comprises a motor operatively connect to said cleaning carriage, a power supply for supplying current to operate said motor, and a control system for controlling the direction of movement of said cleaning carriage.

4. A corona generating device according to claim 1, further comprising a home position in said path on movement of said cleaning carriage, a sensor associated with said home position for sensing when said carriage is in said home position.

5. A corona generating device according to claim 2 wherein said home position includes a protrusion member which engages said translating means thereby advancing said cleaning pad from said one of said plurality of cleaning portions to said second one of said plurality of cleaning portions of said cleaning pad.

6. A corona generating device according to claim 5 wherein said protrusion member contacts said engaging means to disengage said clean pad from contact with conductor.

7. A corona generating device for a printing machine, comprising:

a conductor; said conductor is a wire, a frame for supporting said conductor;

a cleaning assembly, within said frame, for cleaning said conductor, said cleaning assembly includes a cleaning carriage, a drive system for translating said cleaning carriage along the length of said conductor in a path of movement, said cleaning assembly further includes a cleaning pad, means for engaging a portion of said clean pad into contact with conductor, and means for translating said cleaning pad from an used portion to an unused portion of said cleaning pad;

said home position includes a protrusion member which engages said translating means thereby advancing said cleaning pad from said used portion to said used portion of said cleaning pad, said protrusion member contacts said engaging means to disengage said portion of said clean pad from contact with conductor; and wherein said translating means includes a ratchet wheel having a wire pad on a bottom surface thereof and a grid pad on a top surface thereof and a support member, said ratchet wheel being rotatable mounted thereto, said support member having an aperture therein wherein said wire passes there through.

8. A corona generating device according to claim 7 wherein engaging means a wire pad holder adapted to move said wire from an unengaged position to an engaged position in contact with said cleaning pad.

9. A corona generating device according to claim 7 wherein said ratchet wheel has a plurality of teeth and said plurality teeth equal the number of said plurality of wire cleaning portions.

10. A corona generating device according to claim 1 wherein said cleaning pad is comprised of polyester.

11. A corona generating device according to claim 1 wherein said cleaning pad is annular.

* * * * *